United States Patent [19]

Semon

[11] Patent Number: 4,555,119

[45] Date of Patent: Nov. 26, 1985

[54] CASKET SEALING GASKET

[75] Inventor: Joseph R. Semon, Dalton, Pa.

[73] Assignee: Casket Shells, Inc., Eynon, Pa.

[21] Appl. No.: 285,786

[22] Filed: Jul. 22, 1981

[51] Int. Cl.[4] ..... A61G 17/00

[52] U.S. Cl. ..... 277/207 R; 27/17

[58] Field of Search ..... 27/17; 277/207 A, 207 R

[56] References Cited

U.S. PATENT DOCUMENTS 3,065,517 11/1962 Dower ..... 27/17

3,892,417 7/1975 Clayton ..... 277/207 R

*Primary Examiner*—Robert I. Smith

*Attorney, Agent, or Firm*—Kane, Dalsimer, Kane, Sullivan and Kurucz

[57] ABSTRACT

An improved casket sealing gasket system wherein sealing is provided by a plurality of contact points disposed on a plurality of deformable sealing ridges disposed within joints between the casket lid and body, and between upper and lower lid sections in caskets having two-piece lids.

13 Claims, 12 Drawing Figures

34
30
6
6
4
4
7
7
48
46
44
46'
44'
48'
39
38
50
5
5
32
43
52
44
46
48
50
30
48
46
44
46'
44'
39
48'

CASKET SEALING GASKET

This invention relates to new and useful improvements in casket sealing gaskets.

It is an object of the present invention to provide a reliable and efficient casket seal that is easily installed during manufacture of conventional caskets.

It is a further object of this invention to provide a casket sealing gasket that readily deforms to accommodate surface irregularities and obstructions commonly encountered in the joint formed between a casket body and its lid, and between sections of two-piece lids known as a header joint.

A further object of the present invention is to provide a casket sealing gasket particularly adapted to provide a continuous seal in joint areas interrupted by e.g. hardware associated with the alignment and locking of casket lids and pad areas where header joints intersect the joint between a casket body and its lid.

A further object of the present invention is to provide a sealing gasket that will make a proper seal even when slightly creased, the casket lid is slightly misaligned or upon repeated opening and closing of the casket.

With the above and other incidental objects in view as will more fully appear in the description below, the invention intented to be protected by Letters Patent consists of the features of construction, the parts and combinations thereof, and the mode of operation as hereinafter described or illustrated in the accompanying drawings or their equivalents.

BRIEF DESCRIPTION OF THE DRAWINGS

Referring to the accompanying drawings wherein one preferred embodiment is shown.

DETAILED DESCRIPTION OF A PREFERRED EMBODIMENT

Figure 1:
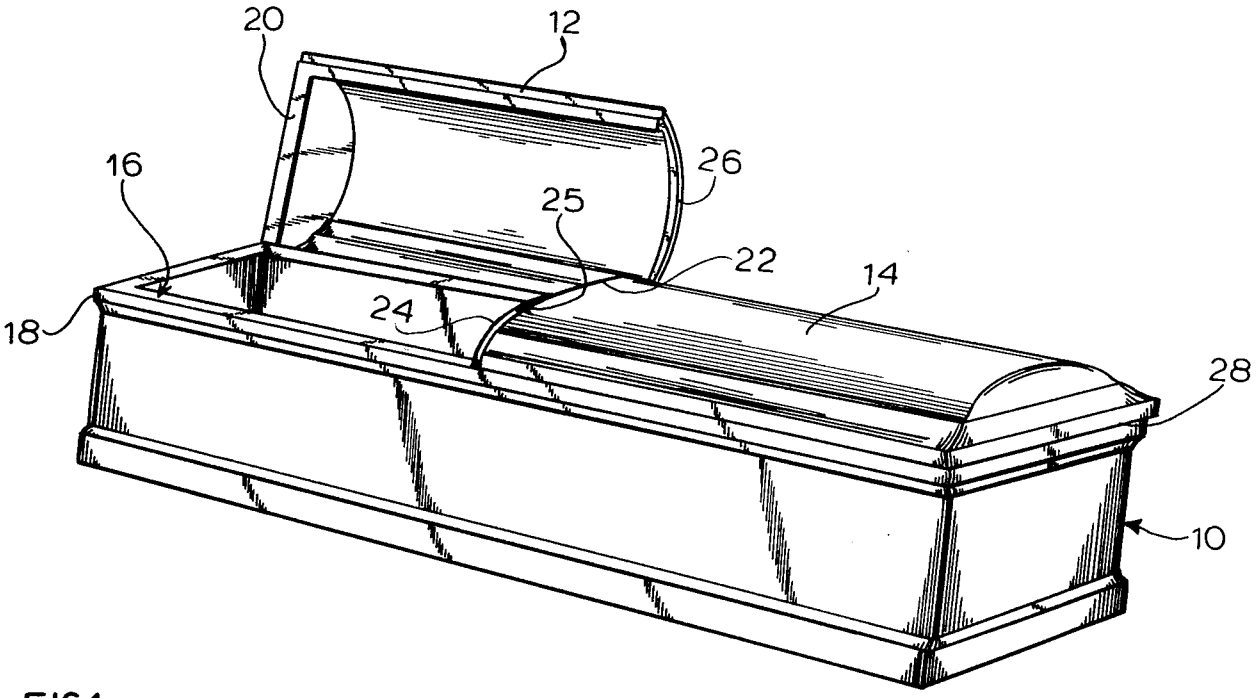
FIG. 1 is a perspective view of a conventional perfection casket.
Figure 2:
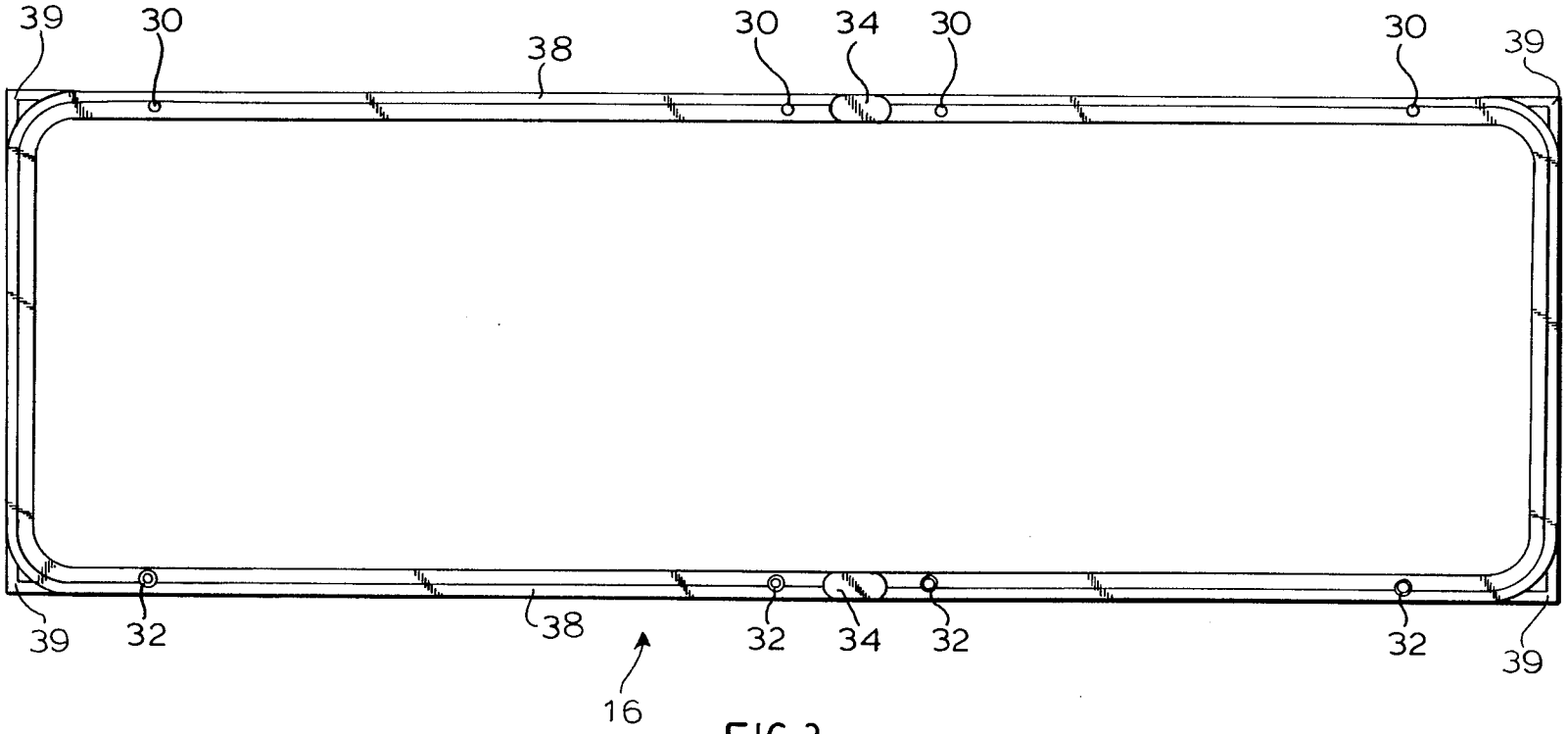
FIG. 2 is a top plan view of a casket sealing gasket constructed in accordance with this invention.

Referring more specifically now to FIG. 1, showing a conventional perfection casket 10 with an open lid section 12 and a closed lid section 14. The present invention, a casket sealing gasket 16, hereinafter described in detail is sealably affixed along the casket body ledge 18 of casket 10, so that when lid sections 12 and/or 14 are closed the sealing gasket 16 is compressed and thereby deformed to accommodate irregularities in the surface of the lid rail section 20, forming a continuously sealed joint about the entire casket 10 periphery, between the casket body ledge 18 and its lid rail 20. The casket sealing gasket 16 top plan view of FIG. 2 details the common positioning of hardware for casket lid hinges 30 and strike holes 32, required for proper fastening and alignment of the lid sections 12 and 14. The hinge holes 30 of this embodiment do not intersect any of the sealing ridges 44, 46 and 48, hereinafter described. They are provided for by a preformed hole through the sealing gasket 16, at appropriate places adjacent to but not intersecting with the massive ridge portion 52, hereinafter described.

The strike holes 32 do intersect the massive ridge portion 52 of the sealing gasket 16 and hence obstruct the otherwise straight path of the seal 28 formed between the casket body ledge 18 and lids 12 and 14.

In caskets of the kind shown herein, having two-piece lids, another obstruction to the path of the seal 28 occurs where the header joint 22 between the upper and lower lid sections 12 and 14, respectively, meet the sealing gasket 16. The lower lid 14 is provided with a lip 24, which fits beneath recess 26 in upper lid 12 when the casket is closed. Lip 24 provides a seat for header gasket 25 which is compressed and deformed by recess 26, when the upper lid 12 is closed forming a seal between the lid sections.

Figures 3, 6:
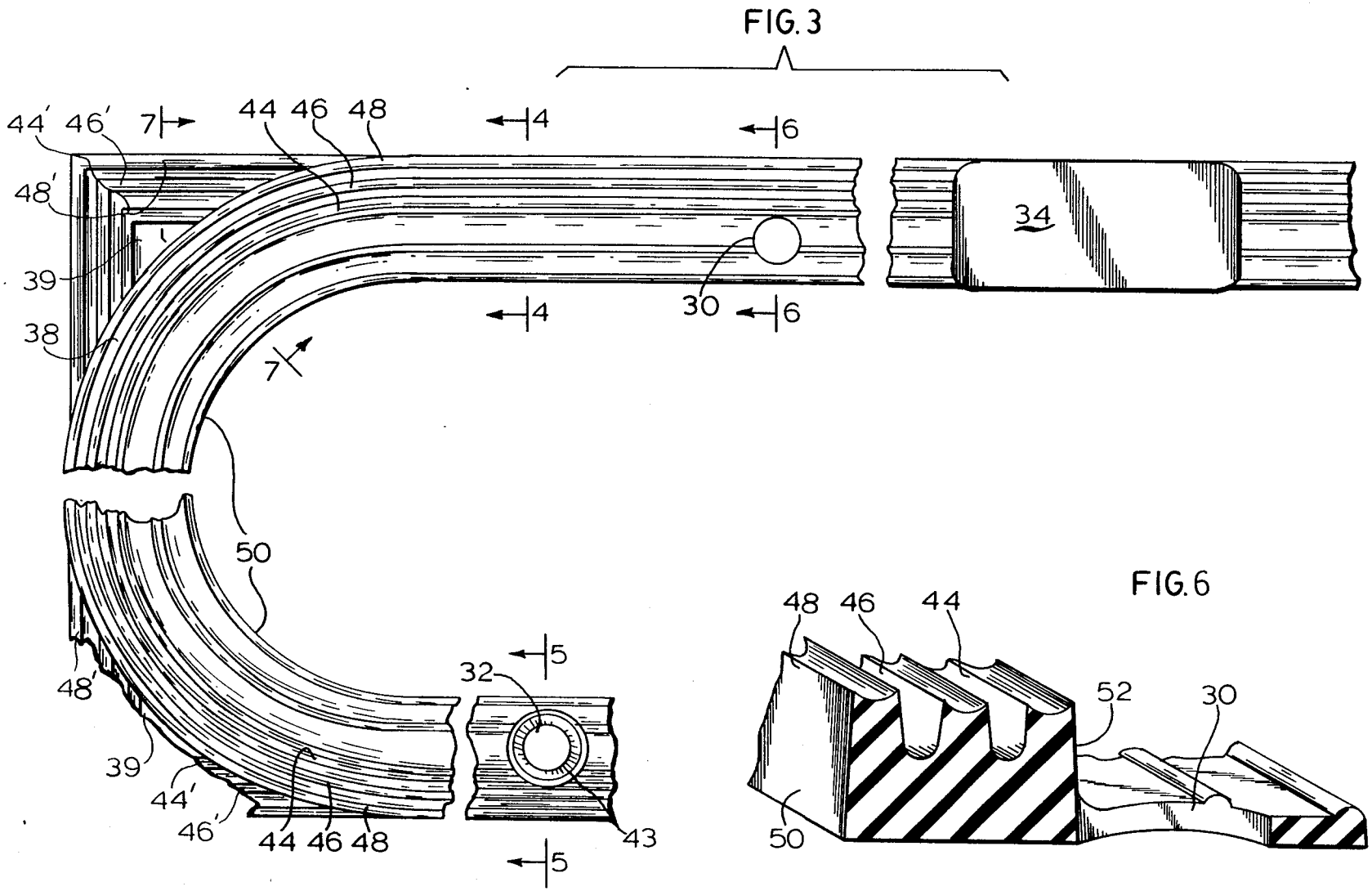
FIG. 3 is a parial detailed top plan view of a casket sealing gasket representing a segment of the casket sealing gasket shown in FIG. 2.
FIG. 6 is a cross-sectional view of FIG. 3 shown along line 6—6.

Details of the sealing gasket 16 are shown in FIG. 3. Through holes 30 for lid hinges are positioned to register with corresponding hinge holes in casket body ledge 18, when the sealing gasket 16 is put into place during manufacture of the casket body 10. Likewise, through holes 32 are provided in sealing gasket 16 to permit locking members (not shown) to pass from the lid or lid sections 12 and 14 into strike holes in casket body ledge 18, through sealing gasket 16. The periphery of sealing gasket 16 is provided with outer ridge 48, intermediate ridge 46 and inner ridge 44. The inner ridge 44 is intersected by through holes 32 but not by through holes 30.

Therefore, a through hole wall 43 having the same height from the bottom surface of sealing gasket 16 is provided to maintain a continuous seal about the entire periphery of seal path 28 in these sections. These features are illustrated in cross-sectional view of FIG. 5.

The three ridges 44, 46 and 48, each arranged atop of massive ridge 52 are provided with a concave peak structure 60 providing a total of six contact points 62 between the gasket body 16, ridges 44, 46 and 48 and the lid sections 12 and 14.

Figure 4:
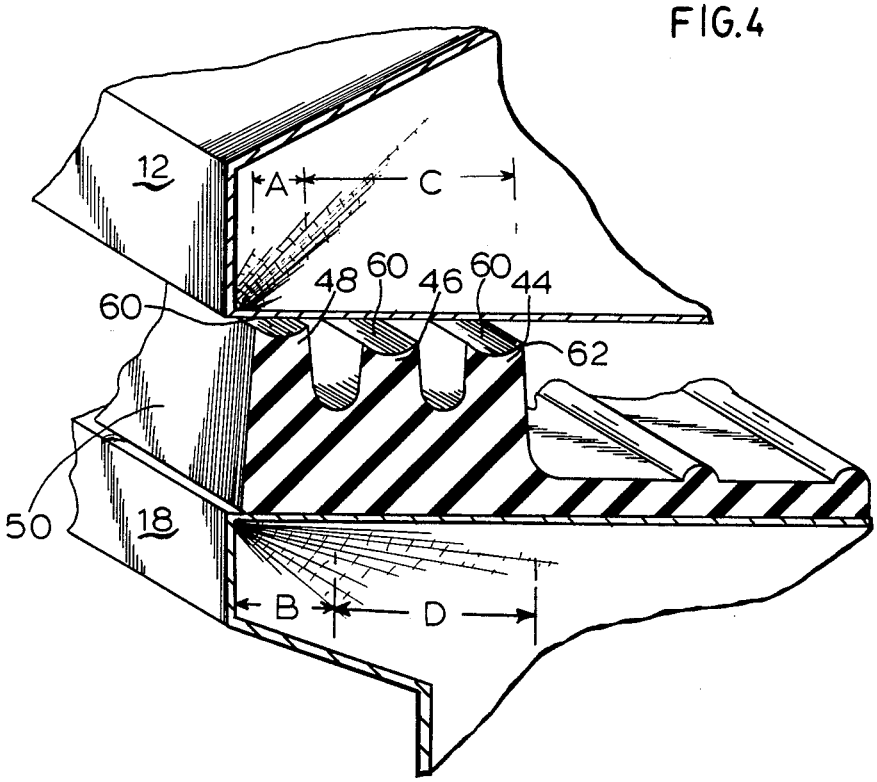
FIG. 4 is a cross-sectional view of FIG. 3 shown along line 4—4.
Figure 5:
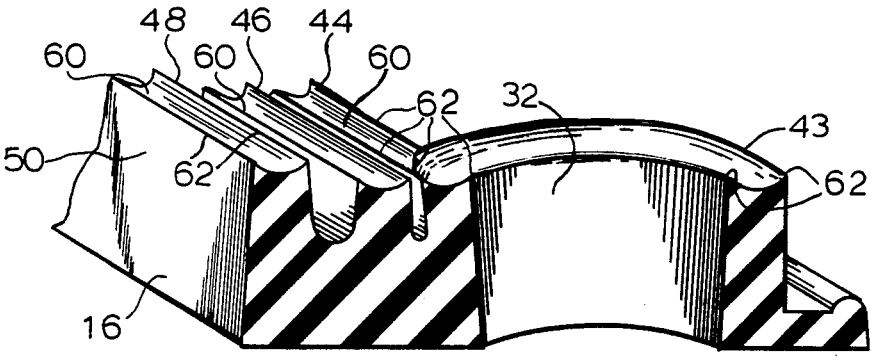
FIG. 5 is a cross-sectional view of FIG. 3 shown along line 5—5.

The concave peak 60 of the outer ridge 48 is slightly elevated (approximately 0.025 in.) with respect to the peaks of ridges 44 and 46, because it is compressed between the stiffest portions of the body ledge 18 and lid rail 20 designated portions -A- and -B- in FIG. 4. Portions -A- and -B- experience greater deformation than sections -C- and -D-, which compress ridges 44 and 46 for a given lid closing force between body ledge 18 and lids 21 or 14 as shown in FIG. 5. Consequently, when the upper and lower casket lids 12 and 14, respectively, are closed onto the casket body ledge 18 as in FIG. 4, contact is first made with the outer ridge 48, deforming it, permitting contact with the intermediate ridge 46 and inner ridge 44, which are subsequently deformed, but obviously to a lesser extent than ridge 48, because of the difference in height. As a result, the casket body ledge 18 and lid rails 20 are not deformed by the elastic deformation forces of the intermediate and inner ridges 44 and 46 to the point that the sealing features of the casket are overridden.

In pad areas 34 where the header joint 22 intersects the gasket body 16, when the casket is closed, perforations 70 are provided in the underside of the gasket body 16. These perforations 70 give the pad areas 34 a softer more yielding nature to ensure proper sealing in this area.

Figure 7:
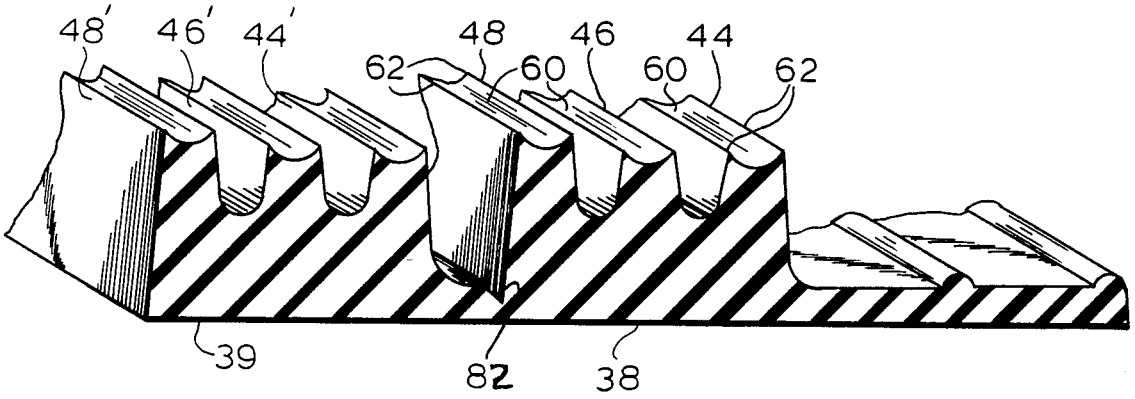
FIG. 7 is a cross-sectional view of FIG. 3 shown along line 7—7.
Figure 8:
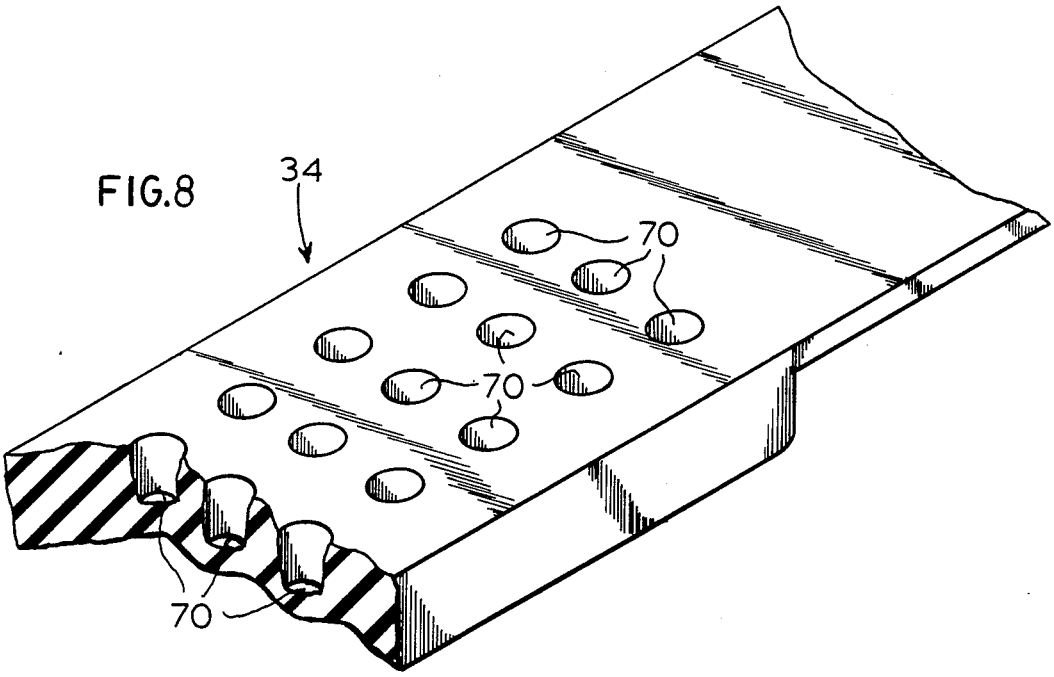
FIG. 8 is an enlarged fragmentary view of the underside portion of FIG. 3 designated 34.

The corners of the gasket body 16 are provided with square trim sections 39 having the same triple ridge six contact point design as the curved corner sections 38 they overlap. Therefore, the same gasket design is adaptable to use with either square or oval caskets. The second group of ridges 48', 46' and 44' are illustrated in FIG. 7, an adjusted cross-sectional view of gasket body 16 along line 7—7. A trimming groove 82 is provided between the first and second group of ridges to facilitate trimming.

Figure 9:
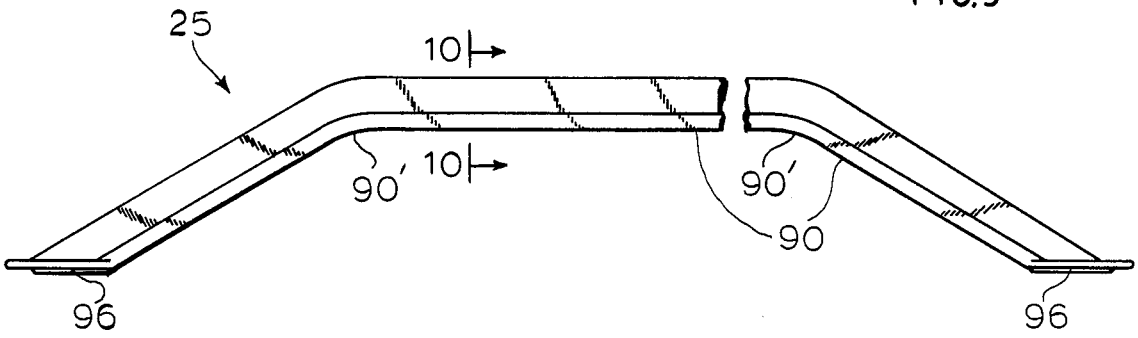
FIG. 9 is a side view of a header gasket constructed in accordance with the present invention.
Figure 10:
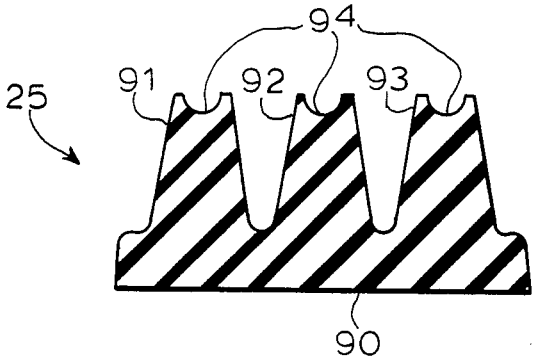
FIG. 10 is a cross-sectional view along line 10—10.
Figure 12:
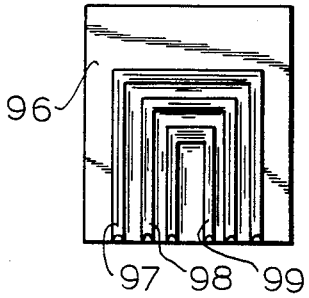
FIG. 12 is a bottom view of foot portion 96.
Figure 11:
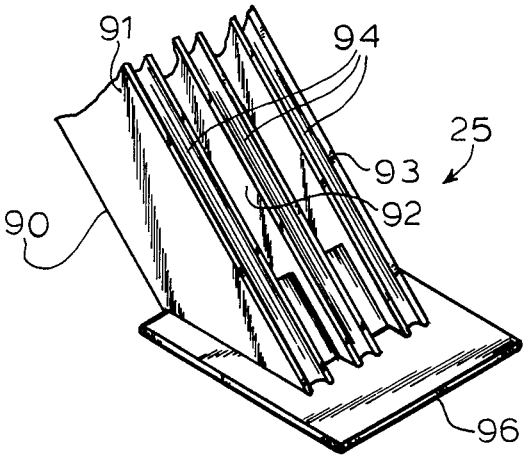
FIG. 11 is a perspective view of the foot portion of the header gasket 25.

The header joint 22 on caskets having two-piece lid designs may also be sealed by a header gasket made in accordance with the present invention. FIG. 9 illustrates such a header gasket 25 having angular portions 90 designed to conform to lip 24 in lower lid 14 of casket 10, facilitating proper gasket alignment and seating. The sealing portion of header gasket 25 similiar to gasket body 16, is provided with an outer ridge 91, an intermediate ridge 92, and an inner ridge 93. Unlike the outer ridge 48, which is slightly taller than its companions 44 and 46; the outer ridge 91 in this embodiment is of the same height as its companions 92 and 93. A concave peak structure 94 provides two contact points on each ridge. The ends of header gasket 90 are provided with a flat foot section 96, on which a series of three small protuberances 97, 98 and 99 form multiple contact points for sealing in a manner similar to ridge peak structures 60 and 94. When the casket lid sections 12 and 14 are closed, header gasket 90 is compressed between lip 24 and recess 26 forming a seal along the joint. The downward force of the lids 12 and 14 also cause foot sections 96 and contact points 97, 98 and 99 to compress against softened pad areas 34 of gasket body 16, making an effective seal in this area.

The gasket body 16 and header gasket 25 are constructed of soft vulcanized durometer rubber, each in one unitized piece to avoid unnecessary seams that could interfere with proper sealing. The gasket body 16 may be provided with a shimmed effect created by gradual thickening toward its corners to compensate for surface irregularities resulting from the grinding of the welds commonly used to secure casket corners.

While the above language specifically describes the best contemplated mode of the present invention in compliance with applicable statutes, it is not intended to limit the invention to the specific features shown, rather it is but one of several modes of putting the invention into practice, and therefore the invention is claimed in any of its forms of modifications within the legitimate and valid scope of any of the appended claims.

What is claimed is:

1. An improved casket sealing gasket which comprises:

a gasket body of deformable material adapted to form a continuous seal within the joint defined by a casket body and its lid;

a plurality of sealing ridges atop the gasket body said sealing ridges disposed parallel to the gasket body periphery;

a plurality of contact points formed by small continuous protuberances in at least one of said sealing ridges uppermost surface; and the uppermost surface of at least one sealing ridge being concave forming two substantially parallel contact points.

2. An improved casket sealing gasket as recited in claim 1, wherein the sealing ridge closest to the gasket body periphery is approximately 0.025 inches taller than other sealing ridges.

3. An improved casket sealing gasket as recited in claim 2, further comprising walls disposed around gasket body openings that intersect at least one of the sealing ridges, said walls having the same height and contact points on their uppermost surface as the intersected sealing ridge.

4. A casket sealing gasket as recited in claims 1, 2 or 3 wherein there are three concave sealing ridges.

5. An improved casket header gasket which comprises:

a gasket body of deformable material adapted to form a seal within a joint between upper and lower lid sections of a casket having a two-piece lid;

a plurality of sealing ridges atop the gasket body, said sealing ridges disposed parallel to the gasket body periphery;

a plurality of contact points formed by small protuberances in at least one of said sealing ridges uppermost surface; and at least one of the sealing ridges having a concave uppermost surface forming two contact points.

6. An improved casket sealing header gasket as recited in claim 5, wherein there are three concave sealing ridges of approximately the same height.

7. An improved sealing casket as recited in claim 5, wherein there are three concave sealing ridges of the same height.

8. A casket sealing system which comprises:

a header gasket for sealing the joint between casket lid sections having a plurality of sealing ridges and contact points on the uppermost surfaces of said sealing ridges;

two flat surfaced feet having a series of small continuous protuberances forming contact points disposed thereon at either end of said header gasket;

a casket gasket for sealing the joint between a casket lid and body having a plurality of sealing ridges with a plurality of sealing ridges with contact points on the uppermost surface thereof; and the header gasket having three sealing ridges having concave uppermost surfaces forming two contact points per sealing ridge; the casket gasket having three sealing ridges having concave uppermost surfaces forming two contact points per sealing ridge; and the outermost casket gasket sealing ridge being approximately 0.025" taller than the other sealing ridges.

9. An improved sealing casket having a body and a lid hingedly coupled therewith which comprises:

a casket having a gasket body of deformable material forming a continuous seal within the joint defined by the casket body and its lid;

a plurality of sealing ridges atop the gasket body said sealing ridges disposed parallel to the gasket body periphery;

a plurality of contact points formed by small continuous protuberances in at least one of said sealing ridges uppermost surface; and the uppermost surface of at least one sealing ridge being concave forming two substantially parallel contact points.

10. An improved casket sealing gasket as recited in claim 9, wherein the sealing ridge closest to the gasket body periphery is approximatley 0.025 inches taller than other sealing ridges.

11. An improved casket sealing gasket as recited in, claim 10, further comprising walls disposed around gasket body openings that intersect at least one of the sealing ridges, said walls having the same height and contact points on their uppermost surface as the intersected sealing ridge.

12. A casket sealing gasket as recited in claims 9, 10 or 11, wherein there are three concave sealing ridges.

13. An improved sealing casket having a body and a two piece lid hingedly coupled therewith which comprises:

a header gasket body of deformable material forming a seal within a joint formed between the lid sections;

a plurality of sealing ridges atop the header gasket body, said sealing ridges disposed parallel to the joint formed between the lid sections;

a plurality of contact points formed by small protuberances in at least one of said sealing ridges uppermost surface; and the uppermost surface of at least one sealing ridge being concave forming two contact points.

* * * * *